US006331051B1

(12) United States Patent
Tajima et al.

(10) Patent No.: US 6,331,051 B1
(45) Date of Patent: Dec. 18, 2001

(54) INK JET RECORDING HEAD AND A METHOD OF MANUFACTURE THEREFOR

(75) Inventors: Hiroki Tajima; Yutaka Koizumi, both of Yokohama; Kiyomi Aono, Kawasaki; Tsutomu Abe, Isehara; Seiichiro Karita, Yokohama; Takeshi Okazaki, Sagamihara; Kouichi Omata, Kawasaki; Masahiko Kubota, Tokyo, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/188,107

(22) Filed: Nov. 9, 1998

(30) Foreign Application Priority Data

Nov. 11, 1997 (JP) ..... 9-325220

(51) Int. Cl.[7] ..... B41J 2/05
(52) U.S. Cl. ..... 347/65
(58) Field of Search ..... 347/12, 13, 65, 347/56, 63, 40, 42; 29/890.1

(56) References Cited

U.S. PATENT DOCUMENTS

| | | | | |
|---|---|---|---|---|
| 4,047,186 | * | 9/1977 | Kendall et al. | 347/47 |
| 4,313,124 | | 1/1982 | Hara | 347/57 |
| 4,345,262 | | 8/1982 | Shirato et al. | 347/10 |
| 4,459,600 | | 7/1984 | Sato et al. | 347/47 |
| 4,463,359 | | 7/1984 | Ayata et al. | 347/56 |
| 4,558,333 | | 12/1985 | Sugitani et al. | 347/65 |
| 4,608,577 | | 8/1986 | Hori | 347/66 |
| 4,723,129 | | 2/1988 | Endo et al. | 347/56 |
| 4,740,796 | | 4/1988 | Endo et al. | 347/56 |
| 4,980,703 | * | 12/1990 | Sakurai | 347/63 |
| 5,375,326 | * | 12/1994 | Usui et al. | 29/890.1 |
| 5,748,213 | * | 5/1998 | Karita et al. | 347/63 |

FOREIGN PATENT DOCUMENTS

| | | | |
|---|---|---|---|
| 54-56847 | 5/1979 | (JP) | B41M/5/26 |
| 59-123670 | 7/1984 | (JP) | B41J/3/04 |
| 59-138461 | 8/1984 | (JP) | B41J/3/04 |
| 60-71260 | 4/1985 | (JP) | B41J/3/04 |

* cited by examiner

*Primary Examiner*—John Barlow
*Assistant Examiner*—Blaise Mouttet
(74) *Attorney, Agent, or Firm*—Fitzpatrick, Cella, Harper & Scinto

(57) ABSTRACT

An ink jet recording head includes a plurality of discharge ports for discharging ink, a plurality of ink flow paths in communication with the plurality of discharge ports, a plurality of substrates including discharge energy generating elements for providing discharge energy for discharging ink, a supporting member for supporting a plurality of substrates in an arranged state, and a ceiling plate member for forming the plurality of ink flow paths by being bonded to a plurality of arranged substrates.

11 Claims, 13 Drawing Sheets

INK JET RECORDING HEAD AND A METHOD OF MANUFACTURE THEREFOR

BACKGROUND OF THE INVENTION

1. Field of the Invention

The present invention relates to an ink jet recording head for recording by discharging recording liquid. The invention also relates to a method of manufacture therefor.

2. Related Background Art

The ink jet recording method is a method whereby to record by discharging liquid droplets (ink) from the fine discharge ports to a recording medium. Since this recording method is of non-impact type, there is no considerable amount of noises, while it is made possible to utilize an ordinary recording sheet for a highly precise recording at higher speeds. There is also an advantage, among many others, that a color recording is possible by use of plural colors of ink. A recording apparatus (an ink jet recording apparatus) that adopts the ink jet recording method is arranged to use, in general, an ink jet recording (IJC) which is formed integrally with discharge ports to discharge ink, and discharge energy generating elements to provide ink with discharge energy. FIG. 15 is an exploded perspective view which shows the structure of the principle parts of the conventional ink jet recording head.

By the application of film formation technologies and techniques, the heater board 910 is provided with a silicon substrate, electrothermal converting member arranged on the silicon substrate (discharge heaters), and the electric wiring of aluminum or the like to supply electric power to the discharge heaters. Also, the printed-circuit board 920 is arranged for the heater board 910. On the printed-circuit board 920, there are provided the wiring (connections by use of wire bonding, for instance) for the heater board 910; a pad 921 positioned on one end of this wiring to receive electric signals from the main body of an apparatus (not shown); and a signal and power supply pad 922 positioned on the other end, which serves as the electrical connector to connect it with the heater board.

The grooved ceiling plate 945 is formed by means of injection molding or the like with an orifice plate provided with an ink inlet opening 942 whereby to receive ink to be supplied from the ink tank and guided to the common liquid chamber which will be described later, and a plurality of discharge ports corresponding to each of the ink flow paths. On this grooved ceiling plate 945, there are arranged, among some others, partition walls to separate a plurality of ink flow paths, respectively, and the common liquid chamber to retain ink to be supplied to each of the ink flow paths. On the grooved ceiling plate 945, the ink flow paths are formed as the respective grooves. For an integral formation of the kind, polysulfone or the like is named as a suitable material, for example.

On the reverse side of the printed-circuit board 920, a supporting member 930 is arranged to support the printed-circuit board 920 flatly. The supporting member 930 is formed by metal, for example, which becomes the bottom plate of the ink jet unit.

The heater board 910, the supporting member 930, and the grooved ceiling plate 945 are fixed to each other by use of the pressure bar spring 950. The pressure bar spring 950 is configured in a U-letter shape to exerts pressure. With the pressure thus exerted, it presses them uniformly in the arrangement direction of grooves that serve as ink flow paths. In other words, the pressure bar spring 950 is arranged to engage with the reverse side of the supporting member 930 with the foot portions 951 extended to pass through the holes 931 of the supporting member 930, respectively. Then, this spring member 950 pinches the heater board 910 and the grooved ceiling plate 945 to engage with each other, and press and fix the heater board 910 and the grooved ceiling plate 945 by the intensive biasing force exerted thereby in cooperation with the front apron portion 952. In this respect, the printed-circuit board 920 is installed on the supporting member 930 by means of adhesive bonding using the bonding agent 932 or the like.

In this manner, the grooved ceiling plate 945 and the heater board 910 are bonded. Thus, the ink flow paths are completed ultimately with the grooves of the grooved ceiling plate 945 and the heater board 910. The end portion of the heater board 910 abuts upon the surface of the reverse side of the orifice plate 940 perpendicularly. There is then no gap created between the grooved ceiling plate 945 and the heater board 910.

The grooved ceiling plate 945 is formed by the simultaneous cutting of the surface of the orifice plate 940 and the ink flow path groove formation surface where the aforesaid abutting surface and the grooves are formed. Then, in the subsequent process, the grooving and drilling are performed by means of laser processing. Further, in the following process, the substrate and the ceiling plate member are bonded to form the ink flow paths as described above.

However, for an ink jet recording head which should be of a large size in order to provide many numbers of discharge ports (2,000 or more, for example), there is encountered a problem that the ceiling plate member presents the warping which is beyond the compulsory control of the laser processing system when the ceiling plate member is processed by the irradiation of laser to process the ink flow path grooves and ink discharge ports continuously per block (128 pieces, for instance), and that there are created per block of processing, steps each having the width of jaw, and also, the drilled area variation of each ink discharge port that follows such step. Here, the contour variations on the circumference of each ink flow path, and the depth variation thereof are also created by the instability of the laser system itself or the like. The contour variations on the circumference of the ink flow paths thus created may cause the defective discharges. For an elongated ink jet recording head, it is particularly important not to allow such variations to take place.

SUMMARY OF THE INVENTION

Now, therefore, the present invention is designed with a view to solving the problems encountered in the conventional art regarding a large ink jet recording head provided with many numbers (2,000 or more) of ink discharge ports. It is an object of the invention to provide an ink jet recording head having a ceiling plate member (a drilled ceiling plate) whose processing precision is enhanced in the direction of ink flow paths and an ink discharge direction. The enhancement is achieved without forming steps having a jaw width; without variation in hole area of the ink discharge ports due to warping of the ceiling plate member; and also without forming variations in configuration and depth of each ink flow path groove due to an instability of the laser apparatus itself, or the like. It is also the object of the invention to provide a method of manufacture of such ink jet recording head.

In order to achieve the objects described above, the ink jet recording head of the present invention comprises a plurality of discharge ports for discharging ink; a plurality of ink flow paths communicated with the discharge ports; a plurality of substrates having discharge energy generating elements for providing discharge energy for ink; a supporting member for supporting a plurality of substrates in a state of being arranged; and a ceiling plate member for forming the ink flow paths by being bonded to a plurality of substrates arranged. For this ink jet recording head, the plurality of substrates are provided with a member becoming the side wall of the ink flow paths and the ceiling plate member has the ink flow path side wall corresponding to the gap between the plurality of substrates, respectively.

Also, the method of the present invention for manufacturing such ink jet recording head, which is provided with a plurality of discharge ports for discharging ink; a plurality of ink flow paths communicated with the discharge ports; a plurality of substrates having a discharge energy generating elements for providing discharge energy for ink; a supporting member for supporting a plurality of substrates in a state of being arranged; and a ceiling plate member for forming the ink flow paths by being bonded to a plurality of substrates arranged, comprises the steps of forming a member becoming a side wall of the ink flow paths on the plurality of substrates; forming an ink flow path side wall on the ceiling plate member corresponding to a gap between the plurality of substrates; and forming the plurality of ink flow paths by bonding the ceiling plate member having the ink flow path side wall with the plurality of substrates having members becoming the ink flow path side walls.

Other objectives and advantages besides those discussed above will be apparent to those skilled in the art from the description of a preferred embodiment of the invention which follows. In the description, reference is made to accompanying drawings, which form a part hereof, and which illustrate an example of the invention. Such example, however, is not exhaustive of the various embodiments of the invention, and therefore reference is made to the claims which follow the description for determining the scope of the invention.

DETAILED DESCRIPTION OF THE PREFERRED EMBODIMENTS

For the ink jet recording head of the present invention, it is possible to manufacture at lower costs such ink jet recording head as having many numbers (2,000 or more, for instance) of ink discharge ports without marring its discharge characteristics by forming the ink flow path walls with the masking arranged by use of dry film (DF) or the like for both ends of discharge energy generating elements on the substrate, while discharge ports are formed on the orifice plate of the ceiling plate member by means of laser drilling. In this way, the influence of warping of the ceiling plate member itself that has been exerted in the conventional art is prevented so as not to affect its manufacture, and the influence that may be exerted by the instable elements of the laser apparatus itself is also made smaller.

It is desirable for the ink jet recording head of the present invention to structure the ceiling plate member with resin in consideration of the ease with which it can be formed, among other aspects. Also, when many numbers of discharge ports should be arranged, a plurality of substrates are used, and these substrates are arranged on a support member. Then, a ceiling plate member, which is provided with a plurality of discharge ports is arranged to be sharable by each of the substrates for use.

In accordance with the present invention, various kinds of discharge energy generating elements can be used. However, it is preferable to use the one that adopts the electrothermal converting member that generate thermal energy for use of ink discharges. When the electrothermal converting member are used, it is preferable to make an arrangement so that ink is discharged from each of the discharge ports by utilization of film boiling created in ink by the thermal energy applied thereto by means of each of these electrothermal converting member.

For the ink jet recording head of the present invention, it is desirable to form ink flow path walls by lamination on both ends of the discharge energy generating elements on the substrate by use of masking of DF (dry film) or the like in a length of 100 μm or more and 500 μm or less from the portion that abuts upon the ceiling plate member (that is, from the edge of the heater board). In addition, it is desirably formed in a height of 20 μm or more and 10 μm or less.

For the ink jet recording head of the present invention, discharge ports are formed by laser drilling directly on the orifice plate arranged for the ceiling plate member. Therefore, it becomes possible to form the discharge ports continuously in higher precision without variations of the drilled areas thereof.

(Embodiments)

Hereinafter, with reference to the accompanying drawings, the description will be made of the embodiments in accordance with the present invention.

(First Embodiment)

Figure 1:
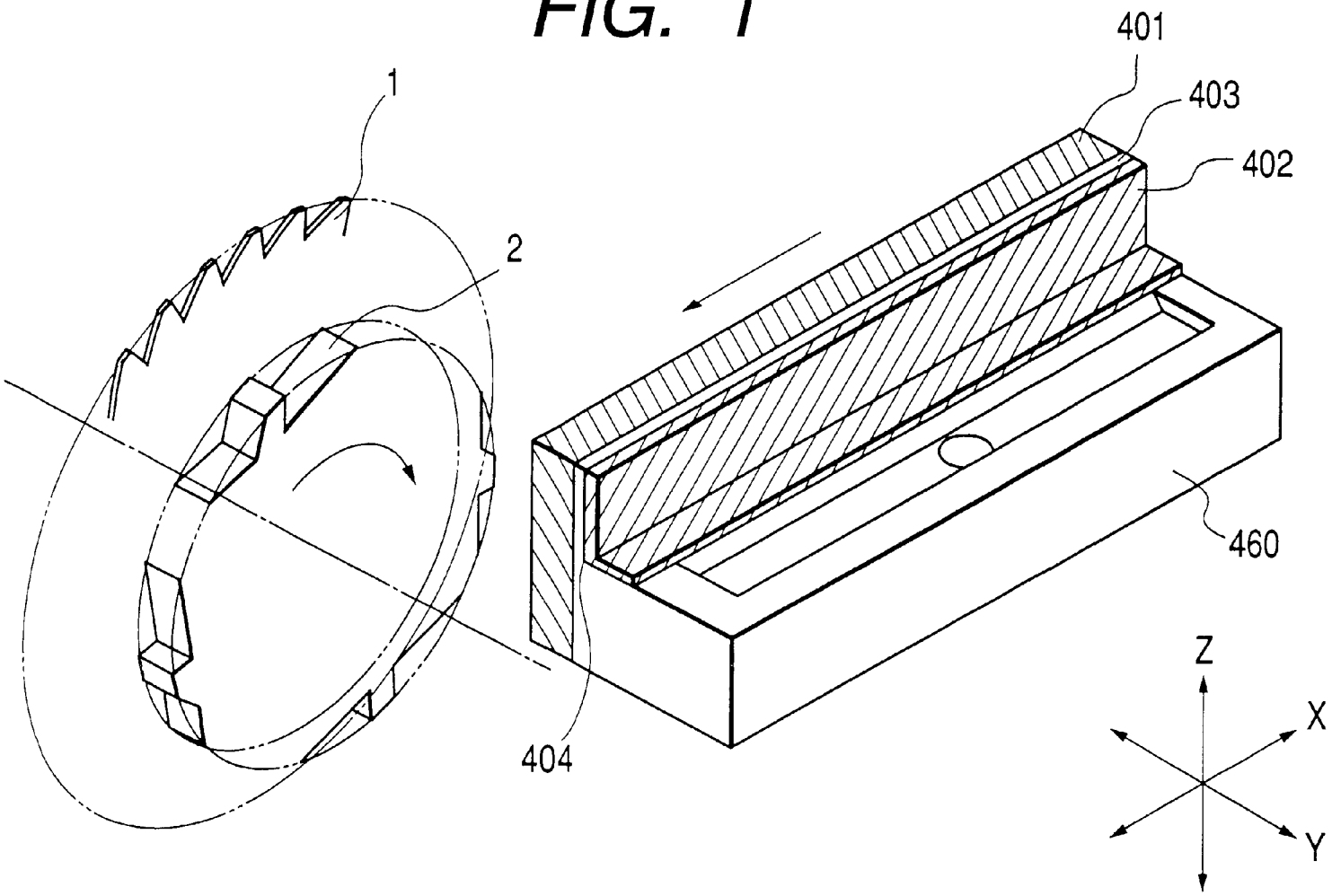
FIG. 1 is a perspective view which shows the state of processing an orifice plate and the formation surface of ink flow path grooves simultaneously in accordance with a first embodiment of the present invention.
Figure 2:
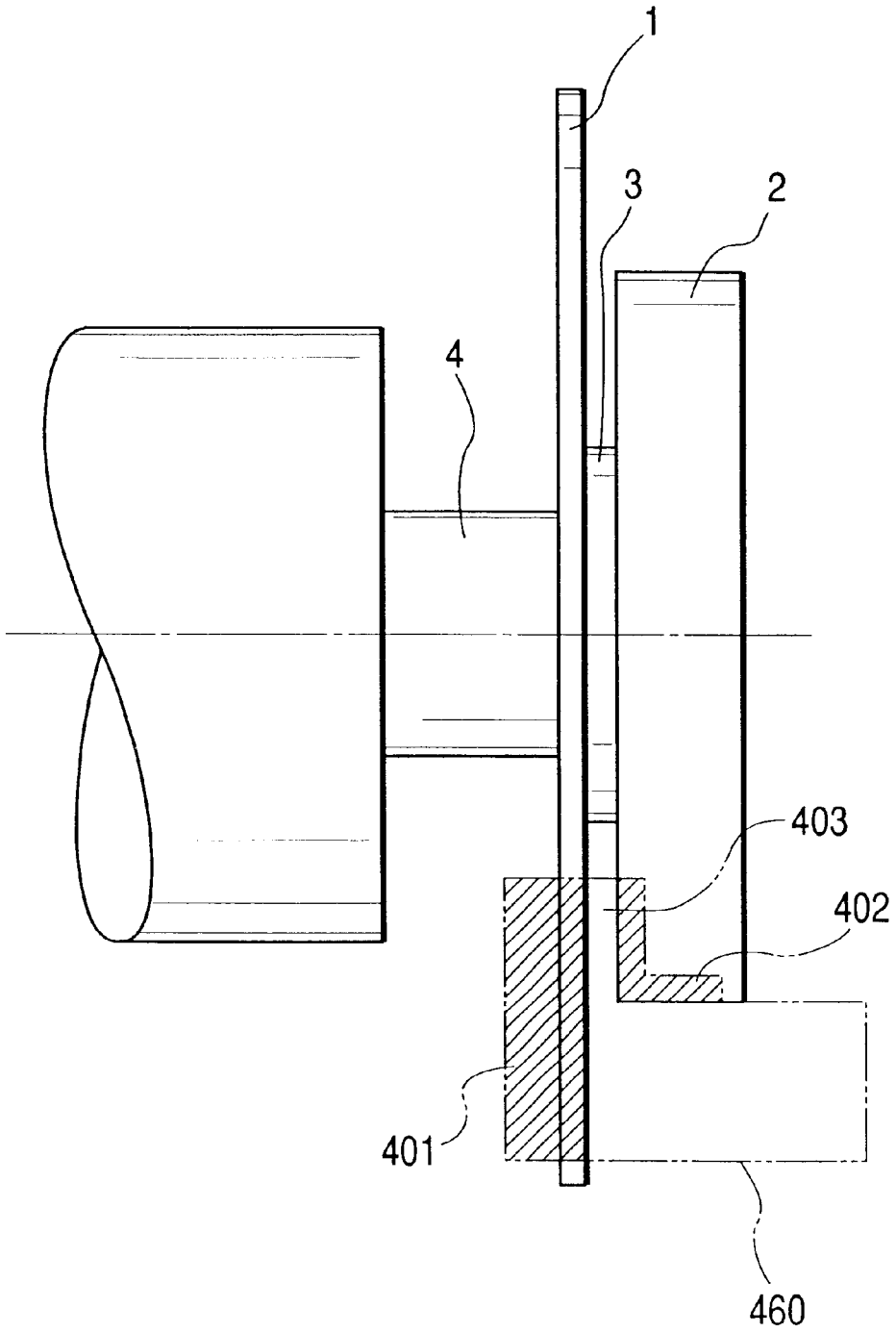
FIG. 2 is a cross-sectional view which schematically shows the state of processing the orifice plate and the formation surface ink flow path grooves in accordance with the first embodiment of the present invention.

FIG. 1 and FIG. 2 are views which illustrate the processing method adopted for the drilled ceiling plate (ceiling plate member) in accordance with a first embodiment of the present invention. FIG. 1 is a perspective view showing the state of processing an orifice plate and the formation surface of ink flow path grooves simultaneously. FIG. 2 is a cross-sectional view which schematically shows the state of processing the orifice plate and the formation surface of ink flow path grooves simultaneously.

Figure 15:
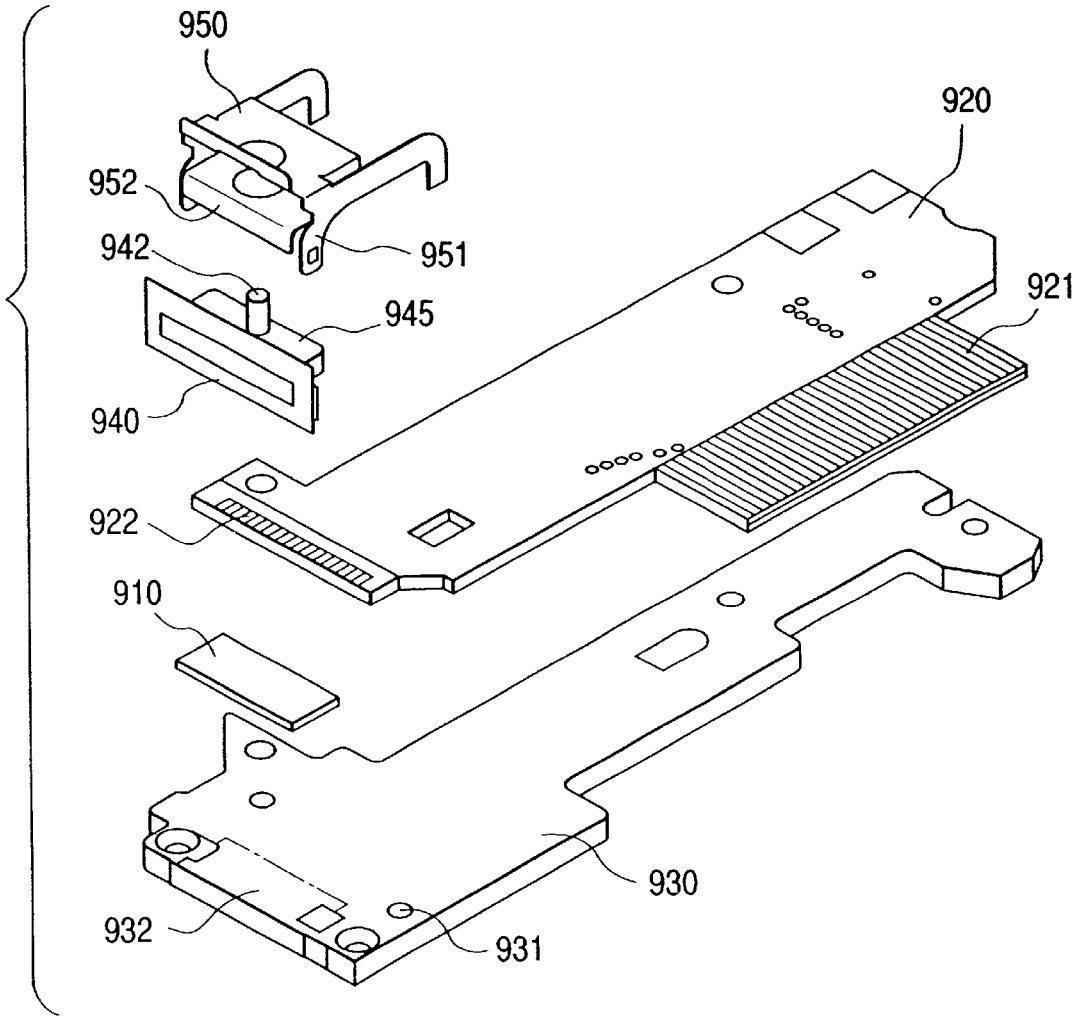
FIG. 15 PRIOR ART
FIG. 15 is an exploded perspective view which shows the structure of the principle part of the conventional ink jet recording head.

Here, the description will be made of the case where the same drilled ceiling plate is manufactured as the grooved ceiling plate 945 of the conventional ink jet recording head shown in FIG. 15.

A molding 460 is formed by means of resin injection molding. This molding is arranged in advance with the functions that the grooved ceiling plate should provide, such as a common liquid chamber, an ink supply opening. This molding 460 has the same configuration as the drilled ceiling plate to be processed, but the position of the orifice plate formation is made thicker in an extra amount in consideration of the warping that may be caused at the time of formation processing. However, no discharge ports nor ink flow path grooves are formed on this molding 460. The portions indicated by slanted lines 401 and 402 are those to be cut off by the cutting operation. When these slanted line portions are cut off, the molding is in the state where the discharge ports and ink flow path grooves are yet to be processed for formation. This molding should be further processed to provide discharge ports so as to obtain the drilled ceiling plate ultimately. Now, the molding in such a state that the orifice plate has been formed although the discharge ports and ink flow path grooves are yet to be processed is referred to as a ceiling plate herein in order to distinguish such molding from the drilled ceiling plate that should be obtained ultimately from it.

For this cutting operation, two disc cutters 1 and 2 are used. These cutters are mounted on one and the same spindle shaft 4 (see FIG. 2). The gap between the cutters 1 and 2 is arranged to be in agreement with the thickness of the portion of the molding 460 which should be left to form the orifice plate 403. The dimension of this gap is appropriately set by adjusting the thickness of the shank of the cutters or by changing the thickness of spacer 3 to be mounted on the spindle shaft 4 between the cutters 1 and 2.

These two cutters 1 and 2 and the spacer 3 for use of providing gap is fastened to be fixed on the spindle shaft 4 of the cutting machine (slicer) through a flange (not shown). Here, the cutter 1 which is arranged on the foot of the spindle shaft 4 is for use of the surface formation of the orifice plate 403 of the drilled ceiling plate. At the same time that this cutter cuts off the thicker portion 401 of the molding 460, it cuts out the surface of the orifice plate 403. Therefore, this cutter should have its configuration which does not cause any scratches or cutter marks that may spoil the discharge functions. On the other hand, the cutter 2 on the tip side of the spindle shaft 4 is to form the formation surface of ink flow path grooves of the drilled ceiling plate and the contact surface (abutting surface) of the heater board simultaneously. Here, the surface roughness of finished plane is sub-micron order. The corner 404 of the abutting portion of the heater board edge should be formed sharp all over the width without C face or R face. Then, this cutter should satisfy the condition that it secures squareness of 5 μm or less per 100 mm. While the cutter 1 is used for the formation of the entire surface on the front of the orifice plate 403, the cutter 2 is used for the formation of the back face on the upper half of the orifice plate. Therefore, the diameter of the cutter 2 should be smaller than that of the cutter 1. Also, the cutter 2 should be able to perform a highly precise process at the blade edge face. In FIG. 1, an arrow indicates the direction in which the molding 460, that is a work, moves when the cutting process is performed as described above.

In consideration of these aspects, the inventors hereof have selected, as a cutter having a small cutting resistance with a good finish of the processed surface, a high speed steel screw slotting cutter (manufactured by Hitachi Tools K.K., for example) of 0.2 to 0.3 mm blade thickness, diameter of 54 to 60 mm, blade numbers of 48 to 52, and the back taper of 1° to 3° at the blade edge. Besides, however, it may be possible to use a cemented tungsten carbide cutter or a screw slotting cutter having the surface treatment of titanium carbide with a view to making the life of the cutter longer. Also, as the cutter 2 installed on the tip side of the spindle shaft 4, the inventors hereof have selected a diamond circular saw (manufactured by the Osaka Diamond Industrial K.K., for instance) which is provided with the monocrystal diamond buried and polished at the blade edge. The blade edge width should be good enough if only it has a width larger than the formation area of ink flow paths. The diameter is 52 to 54 mm, which is smaller than that of the cutter 1. Then, with the combination of the cutter 1, it is made possible for the cutter 2 to operate by use of its blade edge face without engaging in any cut off processing. Besides, it may be possible to use a sintered artificial diamond or a cemented carbide as the material of the blade edge of the cutter 2.

The spacer 3 is formed by a thin stainless steel plate with the etching treatment, for example. Then, it is preferable to determine the thickness of the spacer 3, namely, the thickness of the orifice plate 403, within a range of 20 μm to 50 μm in consideration of the strength of the plate member of the orifice plate 403, as well as the attenuation of laser beam intensity in resin when the orifice plate 403 is drilled using excimer laser in the processing step to follow.

Now, with the selection of cutters 1 and 2, and the formation of the spacer 3, the cutters 1 and 2, and the spacer 3 are fastened and fixed to the spindle shaft 4 of the slicer through the flange (not shown). Here, for the apparatus (slicer) that can demonstrate the initial cutter precision sufficiently, it is important not to exert any vibrations but extremely limited ones when rotating at higher speeds. To this end, the static air bearing is provided for the spindle. The inventors hereof are successful in suppressing the radial thrust vibrations to 1 μm or less at revolution of 10,000 rpm after the installation of the two cutters 1 and 2 by the adoption of the dicing machine (manufactured by The Tokyo Precision K.K.) which is used for processing the silicon wafers and ceramics for use of the semiconductor apparatuses.

By means of the processing system and tools described above, it becomes possible to process simultaneously the orifice plate formation surface of the drilled ceiling plate, the formation surface of the ink flow path grooves, and the bonding surface of the heater board. The result of this processing shows that the thickness variations of the orifice plate 403 per ceiling plate is ±0.5 μm/100 mm or less, and that there are no C face nor R face present on the corner 404 of the heater board abutting surface. Thus, it is possible to form the drilled ceiling plate having the squareness of 5 μm/100 mm or less in the ink discharge direction (direction Y). Also, for this ceiling plate, the roughness of each of the processed surfaces is Rmax 0.2 μm or less, hence making it possible to secure good surfaces that do not exert any influence on the discharge functions. Further, as far as the processing speed is in a range of 30 to 180 mm/min, the resultant cutter marks are not particularly conspicuous to form the orifice plate of 20 μm thick in good condition.

The molding 460 for use of the drilled ceiling plate formation is subjected to the creation of warp due to the shrinkage of resin or the like at the time of formation. However, when the molding 460 is mounted on the work stage of the slicer, only the ink discharge direction (direction Y) is used to abut upon the stage for positioning, and then, the molding 460 is fixed in the direction from top to bottom (direction Z) in FIG. 1 for the cutting operation. In this way, the warping in the ink discharge direction is offset after the cutting operation, and the squareness (warping) is suppressed to 5 μm/100 mm, which does not exert any influence on the functions of the ink jet recording head.

On the other hand, in the direction Z, the original warping returns when the fixation of the processed ceiling plate is released. However, as described earlier, the drilled ceiling plate is closely in contact with the heater board by means of the pressure member (pressure bar spring) which exerts its pressure in the direction Z when the ink jet recording head is actually fabricated. Therefore, as far as the surface roughness satisfies the required finish of the surface which is bonded to the heater board, there is no problem as to a slight warping in the direction Z. Nevertheless, for an ink jet recording head, if the pressure member can be made simpler, it is possible, therefore, to minimize the size and robustness of the head as a whole. With this in view, warping in the direction Z should also be controlled to optimize the entire structure of the head. It is desirable to set the allowable limit of the warping in the direction Z at 50 μm/100 mm or less.

Figure 3:
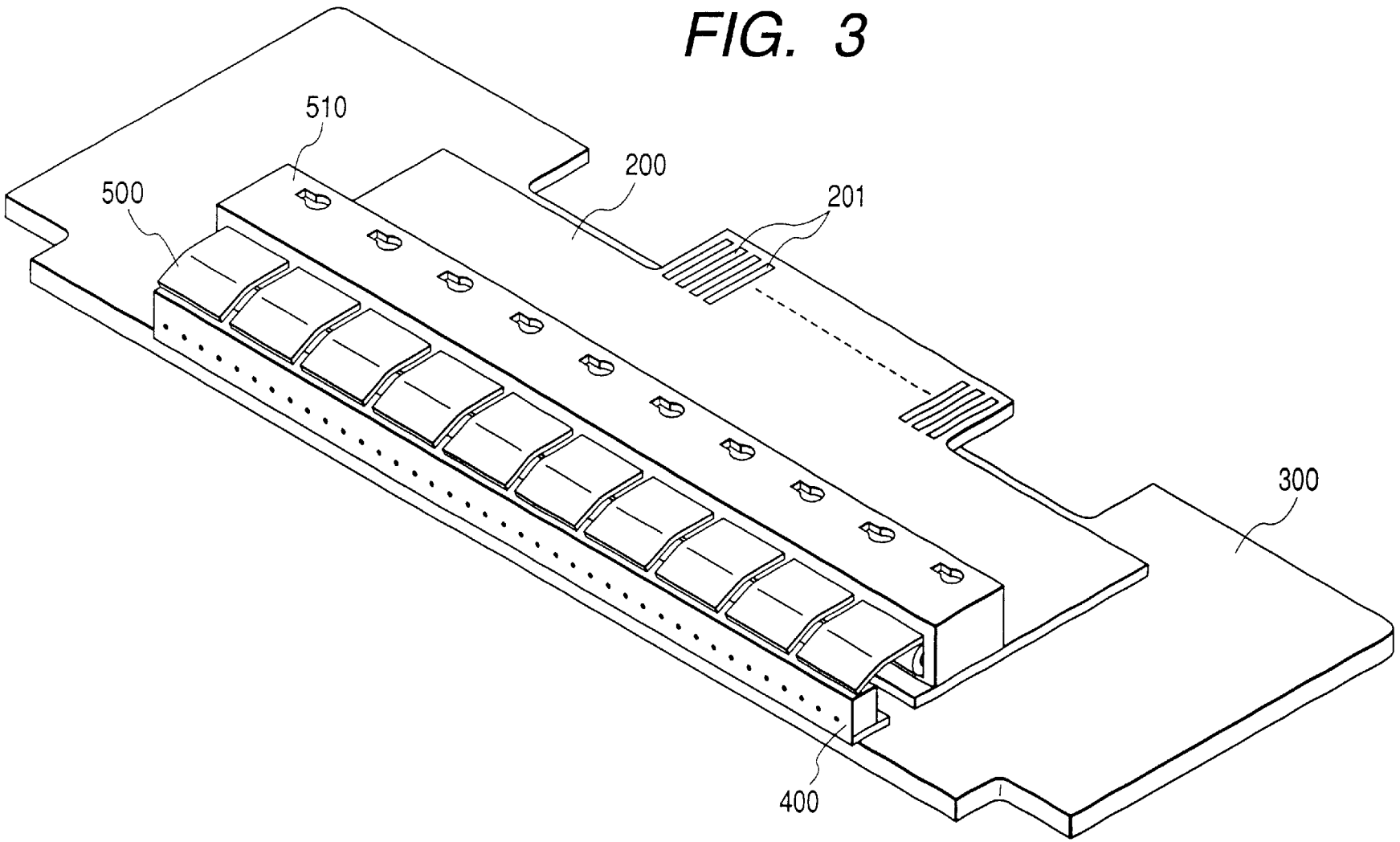
FIG. 3 is a perspective view which schematically shows the structure of an ink jet recording head in accordance with the first embodiment of the present invention.
Figure 4:
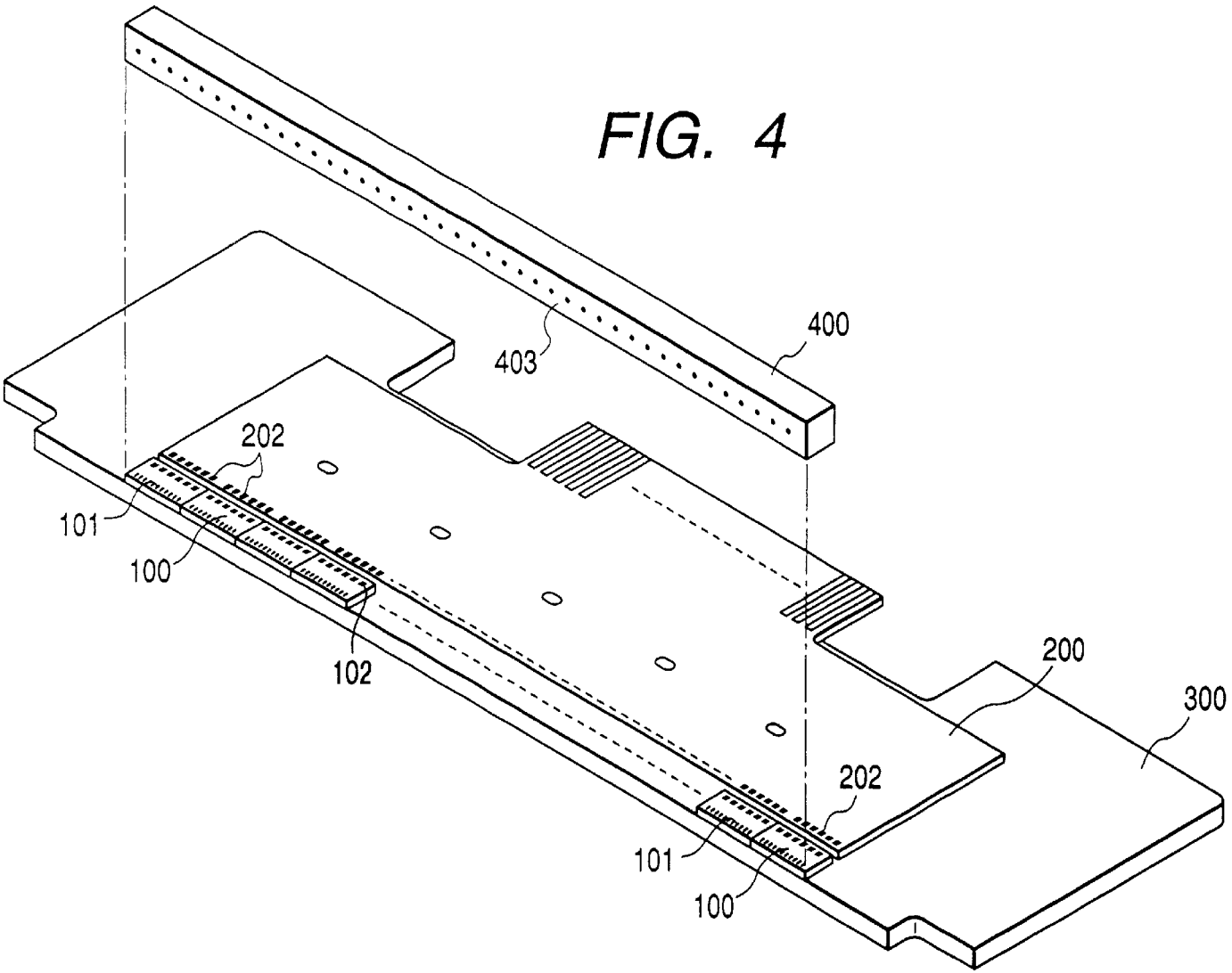
FIG. 4 is a view which illustrates the structure of the principle part of the ink jet recording head in accordance with the first embodiment of the present invention.

FIG. 3 is a perspective view which schematically shows the structure of an ink jet recording head using the drilled ceiling plate obtained by processing the discharge ports after the cutting operation described above. FIG. 4 is a view which illustrates the structure of the principle part of this ink jet recording head. Here, the description will be made of an ink jet recording head whose ink discharge port density is 360 dpi (360 ports per 25.4 mm, that is, at intervals of 70.5 μm), and whose numbers of ink discharge ports are 3,008 (printing width is 212 mm).

Now that the ink discharge ports are 3,008, it is necessary to provide at least 3,008 discharge energy generating elements. Here, a plurality of heater boards (substrates) 100, each having 128 devices, are arranged on the straight line in order to secure a specific number of discharge energy generating elements. Each of the heater boards is provided with 128 discharge energy generating elements 101 in specific positions in a density of 360 dpi. Then, there are provided pads 102 to supply signals, electric power, and the like for driving each of the discharge energy generating elements at arbitrary timing in accordance with electric signals received from external devices. Each of the heater boards 100 is arranged on the surface of the supporting member (base plate) 300 formed by stainless steel, and adhesively bonded to it for fixation by use of bonding agent.

Figure 5:
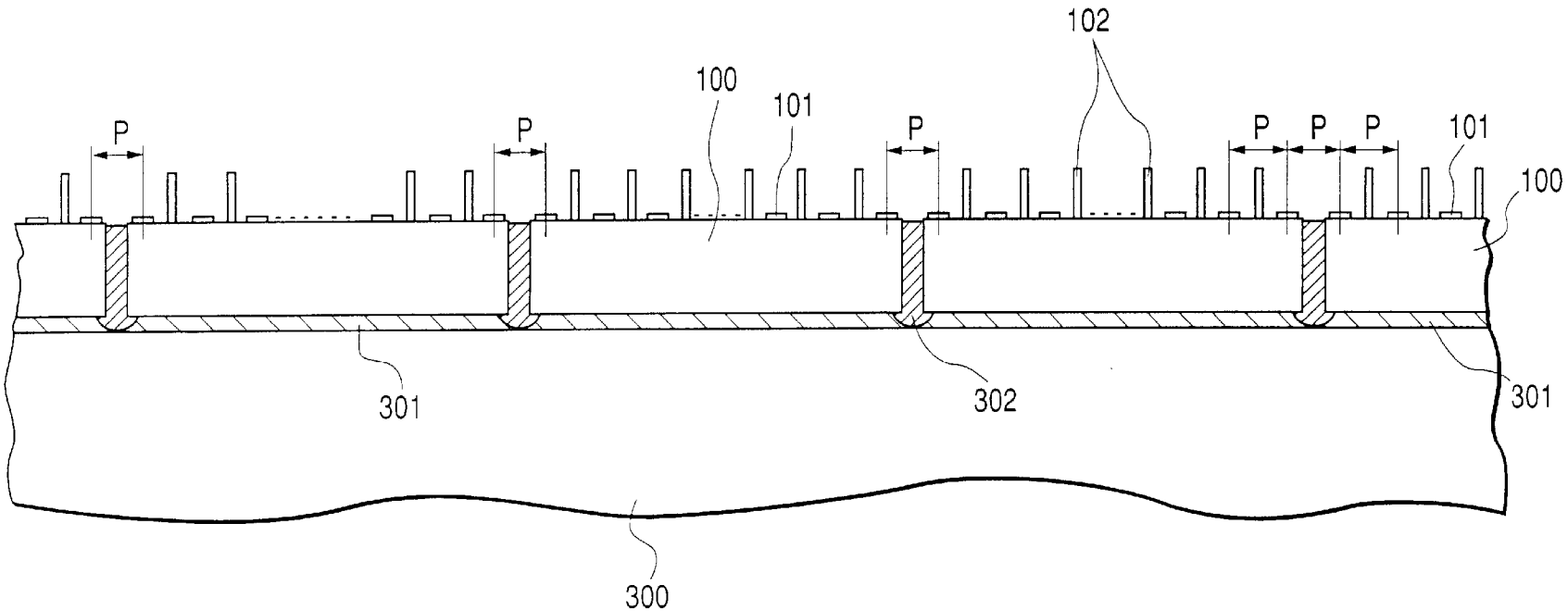
FIG. 5 is a detailed view which shows the state of arranging the heater board.
Figure 6A:
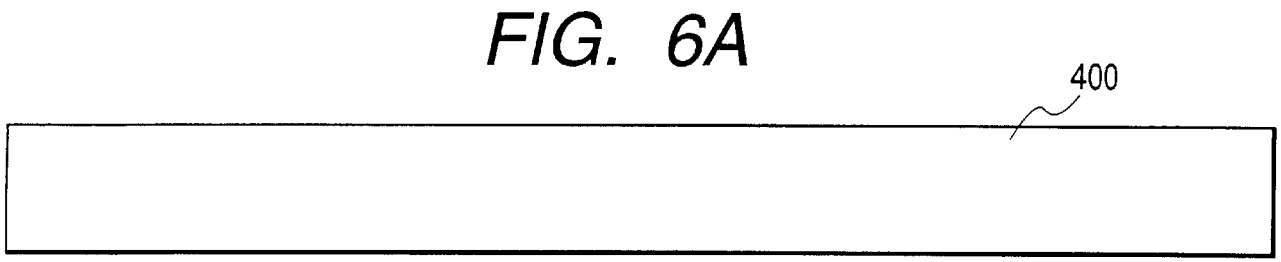
FIG. 6A is a top view which shows a grooved ceiling plate.
Figure 6B:
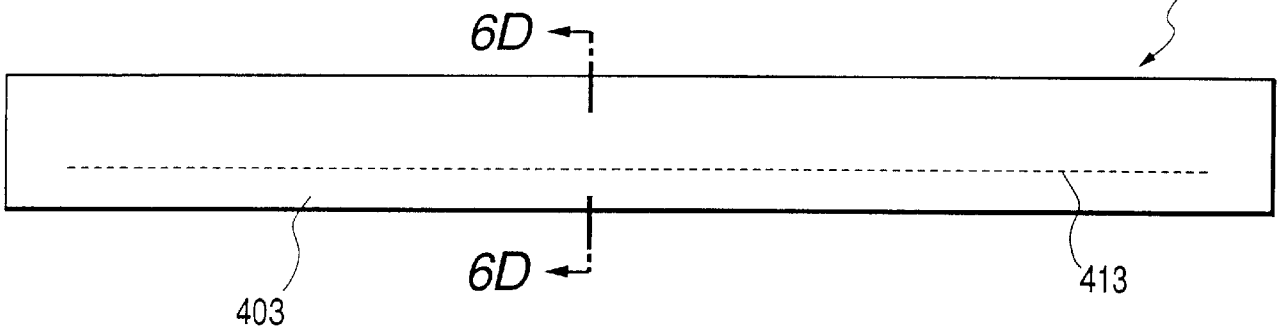
FIG. 6B is a front view of the ceiling plate.
Figure 6C:
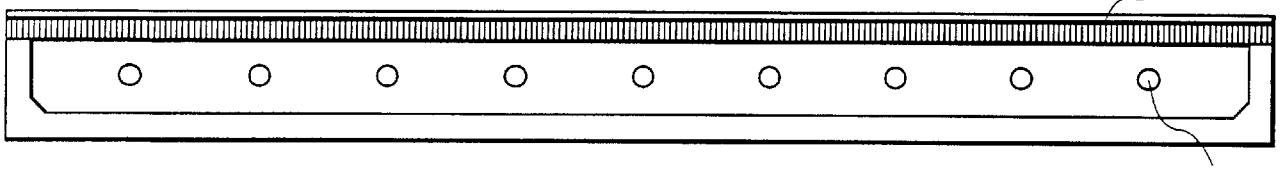
FIG. 6C is a bottom view thereof.
Figure 6D:
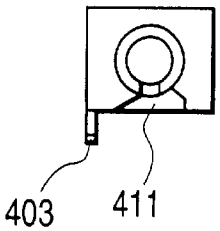
FIG. 6D is a cross-sectional view taken along line 6D—6D in FIG. 6B.

FIG. 5 is a detailed view which shows the state where the heater boards are arranged. Each of the heater boards 100 is adhesively bonded to a specific location of the supporting member 300 for fixation by use of the bonding agent 301 applied in a specific thickness. Here, between the adjacent two heater boards 100, the pitch between the discharge energy generating element on one heater board, which is the nearest to the other heater board, and the discharge energy generating element on the other heater board, which is the nearest to that one heater board, is the same as the pitch P (=70.5 μm) between each of the discharge energy generating elements 101 on each heater board 100. Therefore, even if, for example, 20 heater boards 100 are arranged, each of the discharge energy generating elements 101 is arranged at the same pitch P throughout these heater boards 100. In this case, the adjacent heater boards 100 create a gap between them, but such gap is sealed by a sealant 302.

Specifically, here, as the discharge energy generating elements 101, electrothermal converting member are used, which generate heat by being energized in accordance with recording signals. The discharge energy generating elements 101 are formed on the silicon substrate which serves as the heater board 100 by the application of the semiconductor manufacturing technologies and techniques. Then, when the discharge energy generating element 101 is energized to generate heat, ink in the corresponding ink flow path is heated to bubble. Thus, by means of energy exerted by such bubbling, ink in the corresponding ink flow path is discharged from its discharge port as ink droplets. This bubbling should preferably be created by means of film boiling. As a discharge energy generating element, it may be possible to use the one arranged to be formed by piezoelectric device or the like.

Now, reverting to FIG. 4, the printed-circuit board 200 is adhesively bonded to the supporting member 30, too. The printed-circuit board 200 is arranged to supply signals and electric power to each of the heater boards 100. Then, the printed-circuit board 200 is arranged to provide a specific positional relationship between the pads 102 on the heater boards 100 and the signal and power supply pads 202 on the printed-circuit board 200. On the edge portion of the printed-circuit board 200 on the side opposite to the heater boards 100, the connector 201 is arranged to receive printing signals and driving power from external devices.

Now, the description will be made of the drilled ceiling plate 400. At first, with the method described above, the ceiling plate is formed by simultaneously cutting the surface (discharge port surface) of the orifice plate; the formation surface of ink flow path walls of the ceiling plate which is formed to match with the gap between the adjacent portion of the substrates when being joined to them; and the connecting surface of heater board (abutting surface), hence forming the ceiling plate. Then, on the surface of orifice plate, the water-repellent film is formed in order to prevent the discharge performance from being lowered due to the ink wet on the circumference of each orifice.

After that, by the application of excimer laser, the discharge ports (orifices) are drilled from the reverse side of the orifice plate surface. Using a mask this laser beam processing is repeated per 128-unit which is the same unit of each heater board. In this way, the drilled ceiling plate 400 is completed lastly.

Figure 13:
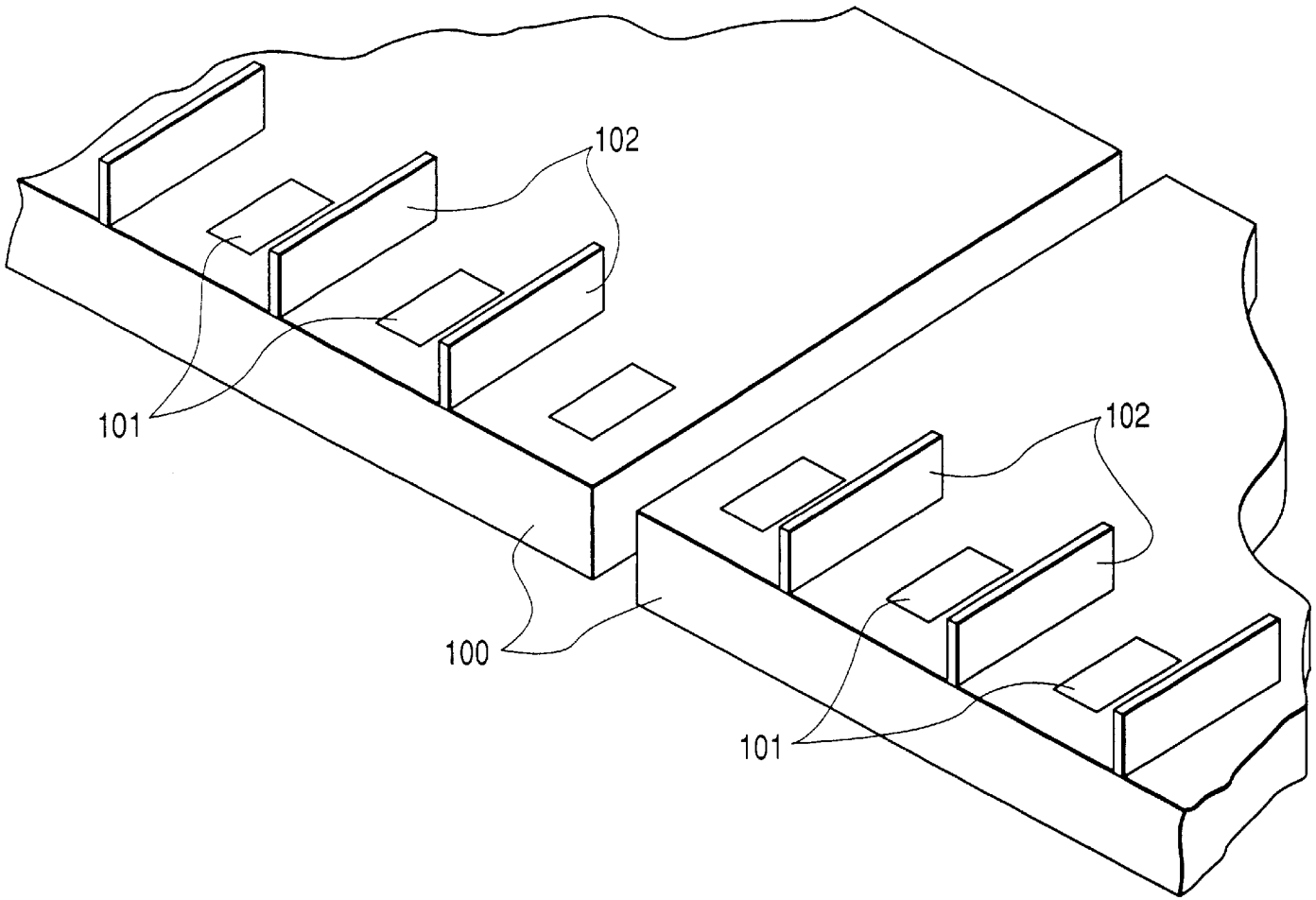
FIG. 13 is a view which schematically shows the flow path walls arranged on the heater board in accordance with the present invention.

Now, the description will be made of the flow path walls 102 arranged on each of the heater boards 100. FIG. 13 is a view which schematically shows the flow path walls arranged on the heater boards. The flow path walls 102 are laminated on each heater board 100 for its formation by being masked with DF (dry film) or the like. In this case, one flow path wall is arranged on the center line between two heaters 101. The wall should be formed in a length of 100 μm or more and 500 μm or less from the abutting portion (heater board edge) of the ceiling plate member, and a height of 20 μm or more and 100 μm or less.

Figure 7:
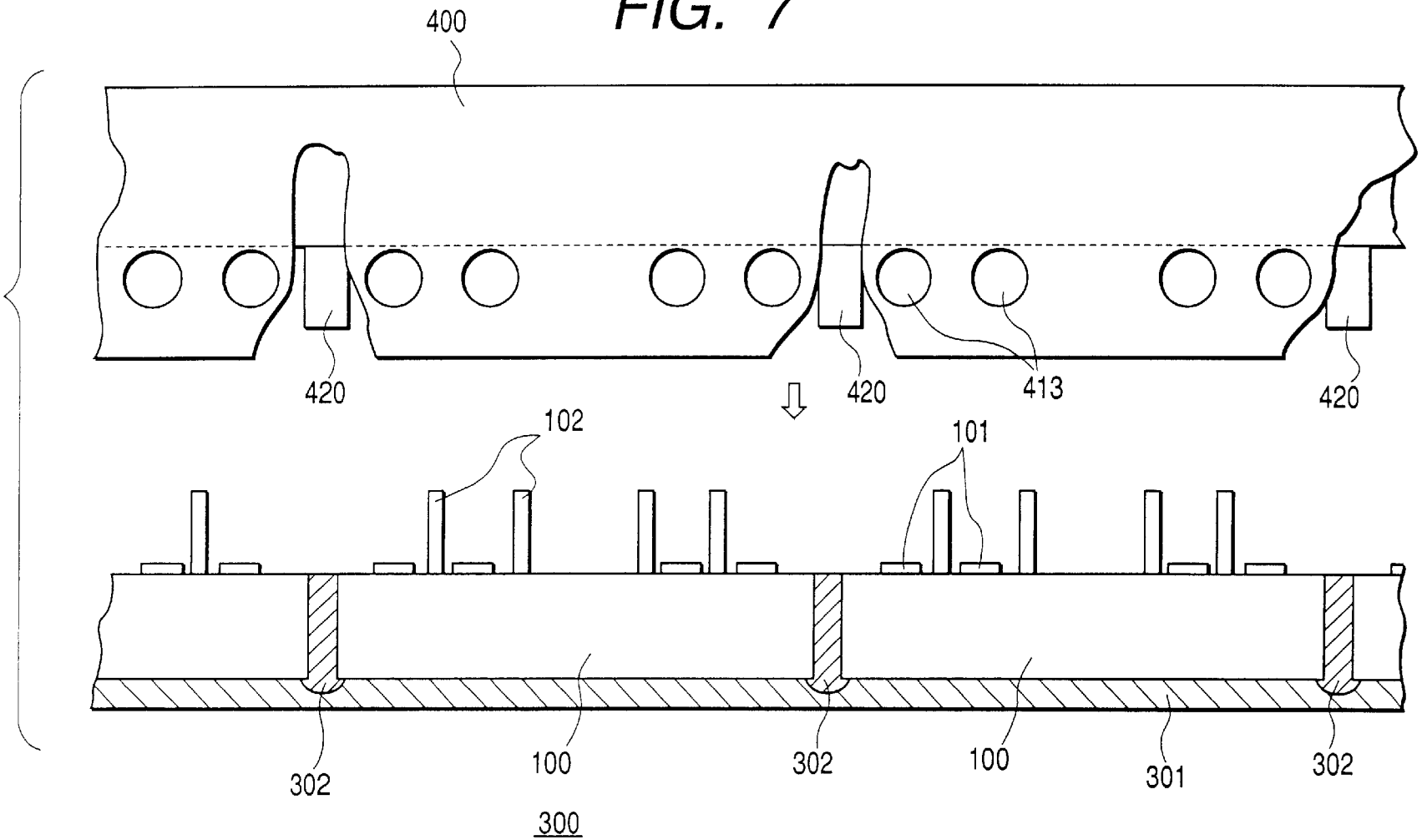
FIG. 7 is a view which schematically shows the positional relationship between a supporting member, a heater board, and a grooved ceiling plate in accordance with the present invention.

As shown in FIGS. 6A to 6D, the drilled ceiling plate 400 is formed integrally with the constituents, such as orifices (discharge ports) 413, the liquid chamber which is communicated with each of the ink flow paths to supply ink, and the ink supply openings 414 to inlet ink to flow from the ink tank (not shown) to the liquid chamber 411. Naturally, the drilled ceiling plate 400 has a length good enough to cover substantially the array of the discharge energy generating elements formed by a plurality of the heater boards 100 in line. Then, as shown in FIG. 4, the drilled ceiling plate 400 is bonded to the supporting member 300 side in such a manner as to enable the positional relationship between the orifices 413 and the discharge energy generating elements on each of the heater boards arranged on the supporting member 300 to be set to present a specific relationship. There are various methods for bonding them, such as to adopt a spring holder 510 which holds a spring 500 and a spring 500 to press them mechanically for bonding; to apply bonding agent to adhesively bond them; or to combine these methods. FIG. 7 is a view which schematically shows the positional relationship between the supporting member 300, the heater boards 100, and the drilled ceiling plate 400.

As shown in FIG. 7, the gaps between the heater boards 100 are arranged to receive protrusions 420 of the drilled ceiling plate 400. FIG. 13 shows a perspective view of the flow path walls 102 and the heaters 101 arranged on the heater boards 100.

As materials with which to form the drilled ceiling plate 400, it is preferable to use resin that enables holes to be formed exactly for the provision of discharge ports. Further, it is desirable to adopt the material which is excellent in presenting the mechanical strength, the dimensional stability, and the resistance to ink. With this in view, it is desirable to use, for example, epoxy resin, acrylic resin, diglycol dialkyl carbonate resin, unsaturated polyester resin, polyurethane resin, polyimide resin, melamine resin, phenol resin, urea resin, or the like. From the viewpoint of formability, resistance to liquids, and others, it is particularly desirable to use resin such as polysulfone or polyether sulfone.

Figure 8:
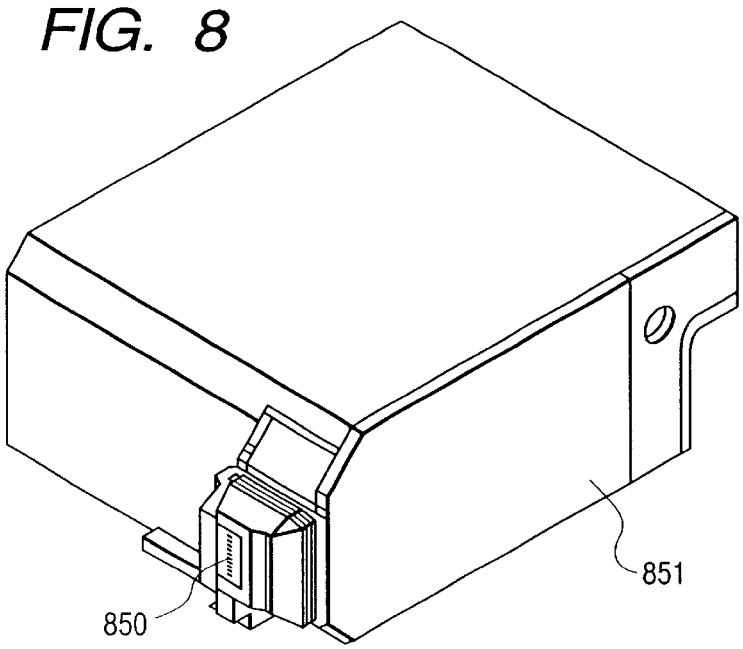
FIG. 8 is a perspective view which shows the structure of an ink jet cartridge to which the ink jet recording head of the present invention is applicable.

Now, in conjunction with FIG. 8 and FIG. 9, the description will be made of an ink jet recording head further in detail. As has been described so far, the ink flow paths are formed by arranging and adhesively bonding a plurality of heater boards having discharge energy generating elements provided therefor on the supporting member formed by glass, silicone, ceramics, metal, or the like, in good precision, and then, the grooved ceiling plate having orifices and liquid flow paths formed thereon is bonded to the integrated body of the heater boards and the supporting member body. In this manner, an ink jet recording head is manufactured. FIG. 8 is a view which schematically shows an ink jet cartridge to which such ink jet recording head is applicable. The ink jet cartridge is detachably mountable on the main body of an ink jet recording apparatus. This cartridge is integrally formed by the ink jet recording head 850 which is the same as the one described above, and the ink tank 851 which is capable of retaining ink to be supplied to the ink jet recording head.

Figure 9:
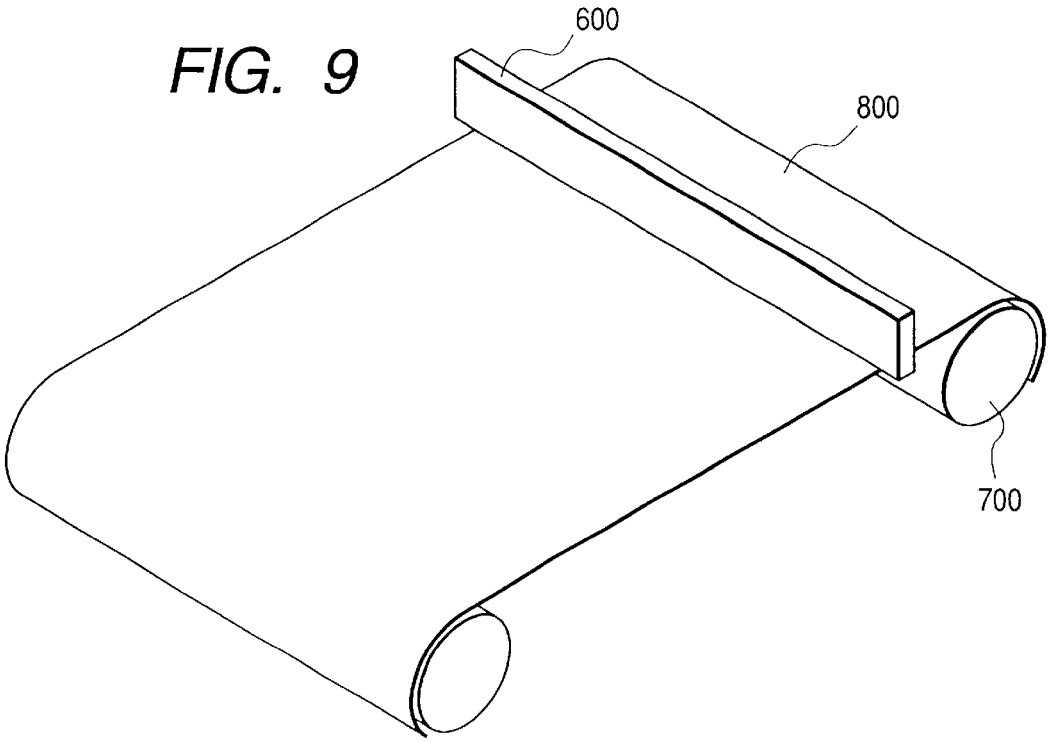
FIG. 9 is a view which shows a full line type ink jet recording head, and the conceptual structure of an ink jet recording apparatus using this type of ink jet recording head.

FIG. 9 is a view which schematically shows an ink jet recording head of the so-called full line type which has the width corresponding to the recording width of a recording medium, and which also shows an ink jet recording apparatus that uses such ink jet recording head. The full line type ink jet recording head has many numbers of discharge ports characteristically. Therefore, the present invention demonstrates its effect most significantly with this type of ink jet recording head.

For this recording apparatus, the full line type ink jet recording head 600 is arranged to face a recording medium 800, such as paper sheet or cloth, carried by use of the recording medium carrier roller 700. While the recording medium 800 is carried, ink is discharged from the full line type ink jet recording head 600 to the recording medium 800 in accordance with the recording signals. In this way, recording is performed on an elongated recording medium 800. In accordance with the present invention, it is easier to manufacture an elongated ink jet recording head like the full line type recording head, because a plurality of heater boards, each having discharge energy generating elements on it, are arranged in line to form such an elongated ink jet recording head.

Figure 10:
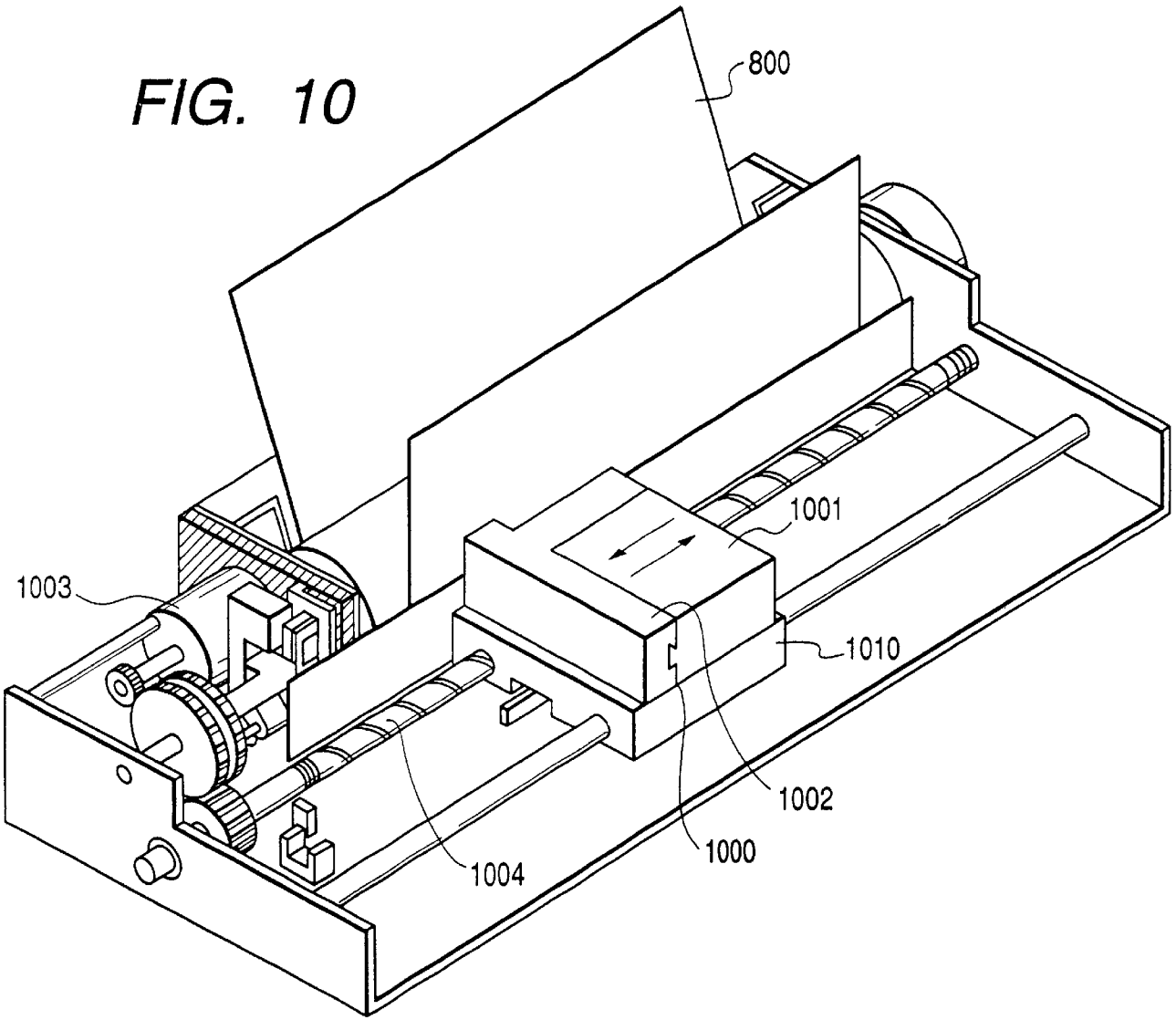
FIG. 10 is a perspective view which shows the structure of an ink jet recording apparatus having an ink jet cartridge thereon, to which the ink jet recording head of the present invention is applicable.

FIG. 10 is a view which shows an ink jet recording apparatus having a small ink jet recording head of cartridge type mounted on it. This recording apparatus uses the ink jet recording head cartridge 1000 having the ink tank unit 1001 and the ink jet recording head unit 1002 integrally formed therefor, which is detachably mountable on the main body of the recording apparatus. The ink jet recording head cartridge 1000 is mounted on a carriage 1010 which can reciprocate in the directions indicated by arrows in FIG. 10. Also, there are provided the carrier roller that carries the recording medium 800; a motor 1003 that serves as a driving power source to drive this carriage 1010; and a carriage shaft 1004 that transmits the power from the driving power source to the carriage 1010, among some others. Further, signal supply means (not shown) is arranged to supply signals to the ink jet recording head unit 1002 for ink discharges.

The description has been made so far with regard to an ink jet recording apparatus that uses the ink jet recording head of the present invention, but the case described here is such that the apparatus mounts only one ink jet recording head which discharges monochrome ink. The present invention, however, is not limited to such recording head. It is of course possible to use an ink jet head of the invention for a color recording apparatus that mounts a plurality of ink jet recording heads each corresponding to each of the plural colors of ink. Furthermore, for the embodiment described above so far, the description has been made of ink as liquid. In this respect, however, it may be possible to adopt the ink which is solidified at the room temperature or less, and then, softened or liquefied at the room temperature. Also, for the ink jet method, it is generally practiced to control the temperature so that the viscosity of ink is kept within the range of stabilized discharges after the temperature of ink itself has been adjusted to the range of 30° C. or more and 70° C. or less. Therefore, it may be possible to adopt the ink that becomes liquefied when the recording signal is given for use. In addition, it may be possible to use the ink which is solidified when it is left intact, but liquefied when heated.

(Second Embodiment)

Now, hereunder, a second embodiment will be described in accordance with the present invention.

Figure 14:
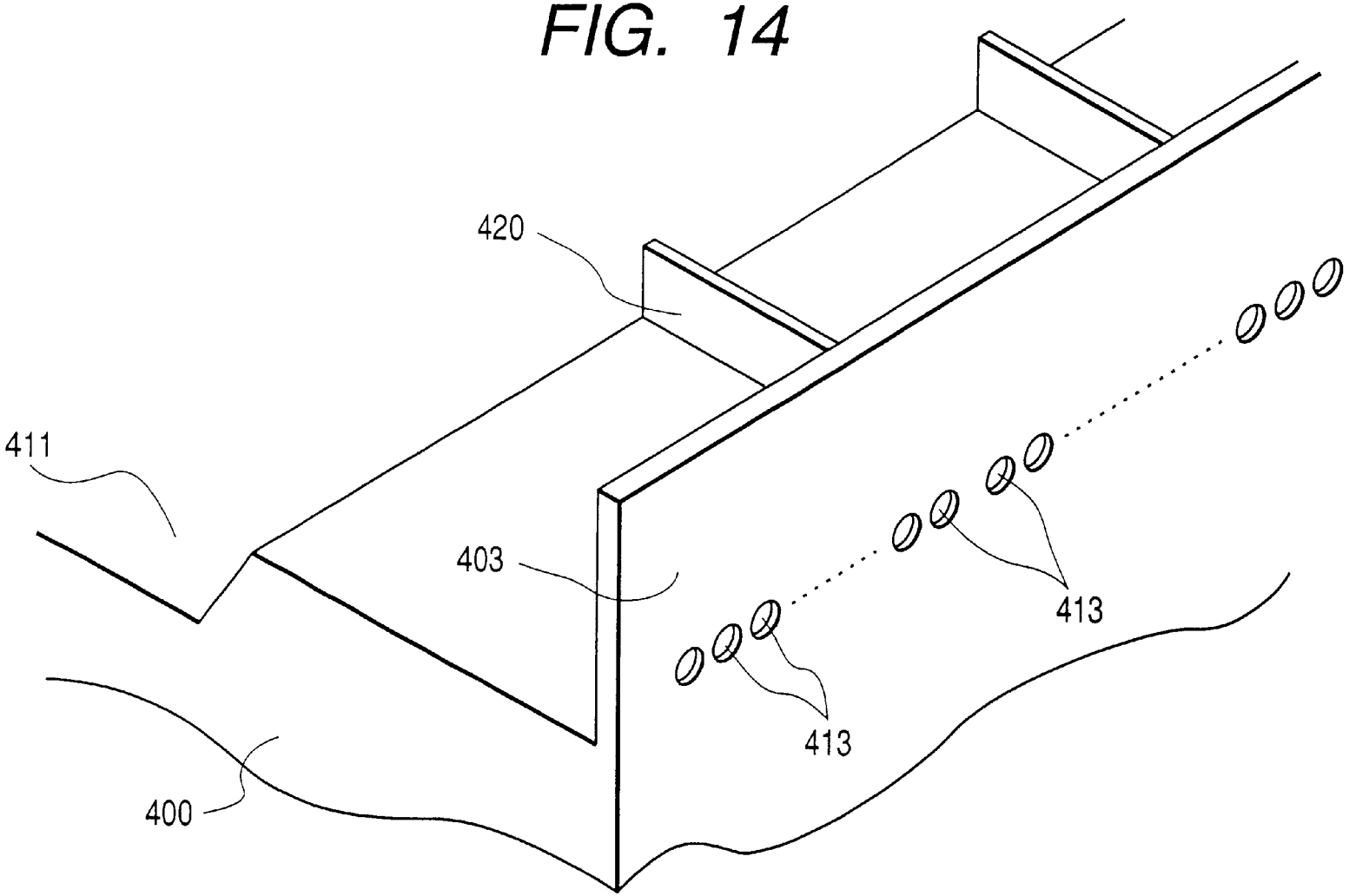
FIG. 14 is a view which schematically shows the structure of the drilled ceiling plate in accordance with the present invention.

In accordance with the first embodiment, the description has been made of the structure of the ink jet recording head which is not influenced by the warping of the ceiling plate itself by bonding the drilled ceiling plate 400 shown in FIG. 14 with the substrate 100 having flow path walls formed hereon with the positional relationship between them as shown in FIG. 7. Here, the description will be made of the embodiment of the processing step in which the bonding of the ceiling plate is simplified in order to make the invention more effective.

On the ceiling plate member 400, only the orifice plate is formed without any drilling process. After this member is bonded to the substrate 100, the drilling is made from the surface of the orifice plate by the application of laser.

Figure 11:
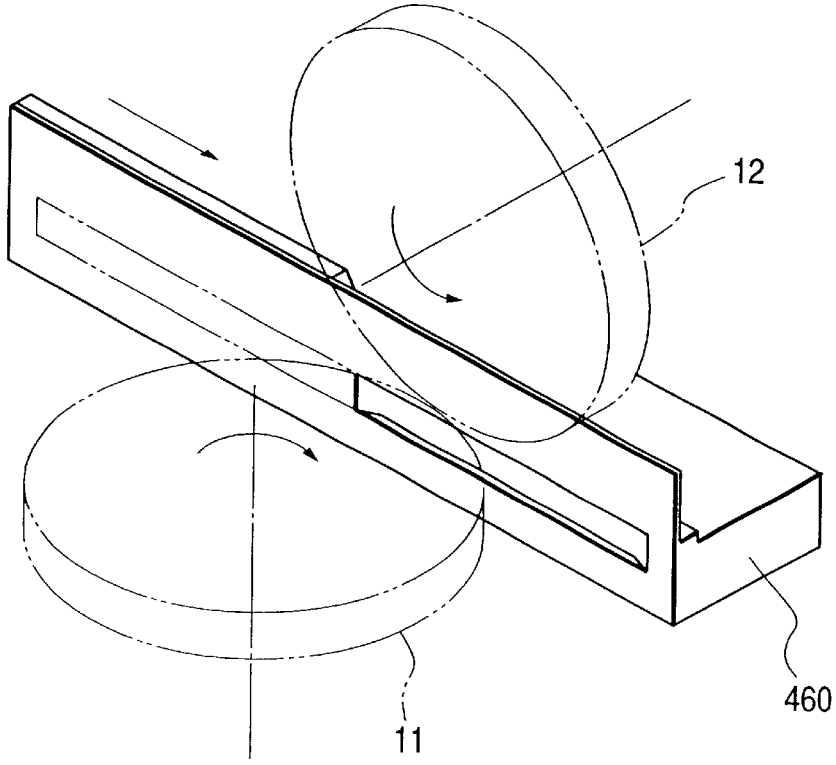
FIG. 11 is a perspective view which shows the state of processing an orifice plate and the formation surface of ink flow path grooves simultaneously in accordance with a second embodiment of the present invention.
Figure 12:
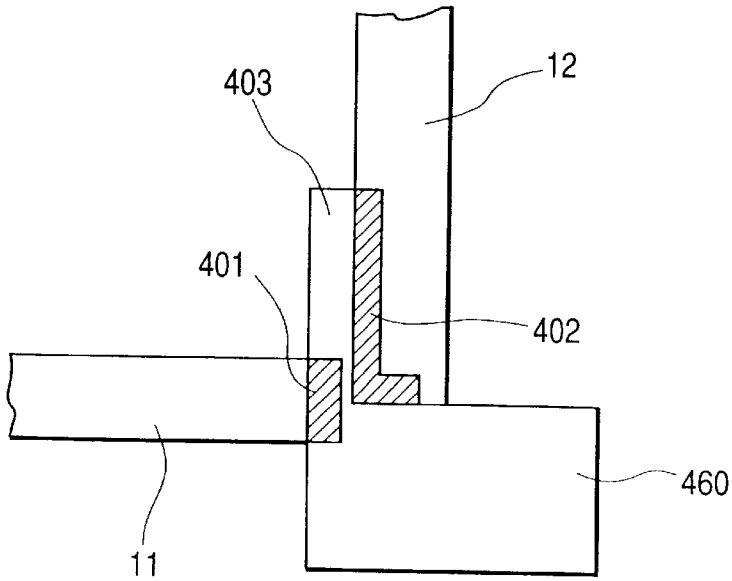
FIG. 12 is a cross-sectional view which schematically shows the state of processing the orifice plate and the formation surface of ink flow path grooves in accordance with the second embodiment of the present invention.

As shown in FIGS. 11 and 12, the portions 401 and 402 of the orifice plate 403 are simultaneously cut by cutting disks 11 and 12.

In this way, there is no longer any need for matching the pitches of the orifices and heaters, hence making it possible to simplify the processing step in this respect.

Also, since the thickness of the orifice plate itself is 20 $\mu$m to 50 $\mu$m, there is almost no possibility that any reverse taper occurs even when the drilling operation is made by the application of laser from the surface of the orifice plate.

Now, as regards the typical structure and principle of the recording head of ink jet type, and the recording apparatus, it is preferable for the present invention to adopt those which can be implemented using the fundamental principle disclosed in the specifications of U.S. Pat. Nos. 4,723,129 and 4,740,796, for example. This method is applicable to the so-called on-demand type recording system and a continuous type recording system as well. In a case of the on-demand type in particular, at least one driving signal is applied to the electrothermal transducing device disposed on a liquid (ink) retaining sheet or liquid flow path, which gives rapid temperature rise beyond the nuclear boiling, in accordance with recording information, thus causing the electrothermal transducing device to generate thermal energy to effectively create bubble in liquid (ink) by such driving signal one to one eventually. By the development and contraction of the bubble, the liquid (ink) is discharged through each discharge port to form at least one droplet. The driving signal is more preferably in the form of pulses because the development and contraction of the bubble can be effectuated instantaneously and appropriately. The liquid (ink) is discharged with quicker response. The driving signal in the form of pulses is preferably such as disclosed in the specifications of U.S. Pat. Nos. 4,463,359 and 4,345,262. In this respect, the temperature increasing rate of the thermoactive surface is preferably such as disclosed in the specification of U.S. Pat. No. 4,313,124 for an excellent recording in a better condition.

As the structure of the recording head, the present invention is effectively applicable to those which are shown in each of the above-mentioned specifications wherein the structure is arranged to combine the discharging openings, liquid paths, and the electrothermal converting member (linear type liquid paths or right-angled liquid paths). Besides, it is equally and effectively applicable to the structure such as disclosed in the specifications of U.S. Pat. Nos. 4,558,333 and 4,459,600 in which the thermal activating portions are arranged in a curved area. In addition, the present invention is effectively applicable to the structure disclosed in Japanese Patent Laid-Open Application No. 59-123670 wherein a common slit is used as the discharging ports for plural electrothermal transducing elements, and to the structure disclosed in Japanese Patent Laid-Open Application No. 59-138461 wherein an aperture for absorbing pressure waves of thermal energy is formed corresponding to the discharge ports.

Further, for the full-line type recording head whose length corresponds to the maximum width of a recording medium recordable by a recording apparatus, the present invention demonstrates its effect more conspicuously irrespective of the structure whereby to satisfy the required length by combining a plurality of recording heads or the structure whereby to integrally form one recording head. In addition, the present invention is effectively applicable to an exchangeable recording head of a chip type that can be electrically connected with the apparatus main body, the ink supply therefor being made possible from the apparatus main body, when mounted on the apparatus main body or to the use of a cartridge type recording head provided integrally for the recording head itself.

Also, it is preferable to additionally provide a recording head with recovery means and preliminarily auxiliary means, because these additional means will contribute to making the effectiveness of a recording apparatus more stabilized. To name them specifically, these are capping means, cleaning means, suction or compression means, preheating means such as electrothermal converting member or heating devices other than such transducing devices or the combination of those types of devices, and a predischarge means for performing discharge other than the regular discharge with respect to the recording head.

Also, as the recording modes of a recording apparatus, the present invention is not only applicable to a recording mode in which only one main color such as black is used for recording, but also, the invention is extremely effective in applying it to an apparatus having plural recording heads provided for use of at least one of multiple colors prepared by different colors or full-color prepared by mixing colors, irrespective of whether the recording heads are integrally structured or structured by a combination of plural recording heads.

By use of the alloys in accordance with the present invention, it is possible to obtain an ink jet recording head and an ink jet recording apparatus, which are provided with electrothermal converting member, each having heat resistor excellent in resistance to the cavitation shocks; resistance to erosion caused by cavitation; resistance to acid; resistance to solution; resistance to heat; resistance to thermal shocks; mechanical durability, and others. Particularly, in accordance with the present invention, it is possible to obtain an ink jet recording head and ink jet recording apparatus, which are structured to enable the heat generating portion of each heat resistor to be directly in contact with ink in each ink flow path. With the ink jet recording head and the ink jet recording apparatus thus structured, it is possible to allow the thermal energy generated in the heat generating portion of each heat resistor thereof to act upon ink directly. Therefore, the efficiency of heat transfer to ink is excellent. The resultant power dissipation by each of the heat resistors is minimized, hence making it possible to make the temperature rise (the temperature changes of an ink jet recording head) extremely small. In this way, it becomes possible to avoid the creation of uneven image densities due to the temperature changes of the ink jet recording head, while obtaining a better response of each heat resistor to the discharge signal applied to it.

Further, in accordance with the heat resistors in accordance with the present invention, it is possible to obtain a well-controlled specific resistance as desired within one ink jet recording head without the extremely small fluctuation of the resistance value.

Therefore, in accordance with the present invention, it becomes possible not only to perform ink discharges far more stably than the conventional device, but also, to obtain the ink jet recording head and the ink jet recording apparatus, which provide excellent durability.

The ink jet recording head and apparatus with excellent characteristics as described above are most suitable for the high-speed and high image quality recording brought force by the adoption of multiple discharge ports.

In the embodiments of the present invention described above, while the ink has been described as liquid, it may be an ink material which is solidified below the room temperature but softened or liquefied at the room temperature or softened or liquefied within a temperature range of the temperature adjustment generally practiced for an ink jet recording, that is, 30° C. or more and 70° C. or less. Here, it should be good enough if only ink is liquefied at the time of giving recording signals for use. In addition, while positively preventing the temperature rise due to thermal energy by the use of such energy as an energy to be consumed for changing states of ink from solid to liquid, or by the use of the ink which will be solidified when left intact for the purpose of preventing the ink from being evaporated, it may be possible to adopt for the present invention the use of an ink having a nature of being liquefied only by the Application of thermal energy, such as an ink capable of being discharged as ink liquid by enabling itself to be liquefied anyway when the thermal energy is given in accordance with recording signals, and an ink which will have already begun solidifying itself by the time it reaches a recording medium. In such a case, it may be possible to retain ink in the form of liquid or solid in the recesses or through holes of a porous sheet such as disclosed in Japanese Patent Laid-Open application No. 54-56847 or 60-71260 in order to enable the ink to face the electrothermal converting member. In the present invention, the most effective method for the various kinds of ink mentioned above is the one that enables the film boiling method to be effectuated as described above.

As described above, in accordance with the present invention, the ink flow paths are formed for the ink jet recording head by the provision of flow path walls arranged between the substrate and the ceiling plate member, which are bonded together. For this recording head, the ink flow path walls are formed on both sides of the discharge energy generating elements arranged on the substrate, while on the orifice plate of the ceiling plate member, only the ink discharge ports are formed. In this way, there is no influence that may be exerted by the warping of the ceiling plate member itself as in the conventional art. No steps are created which have the width of a jaw, and no variations occur in the hole area of the ink discharge ports. Also, it is made possible to minimize the influence that may be exerted by the instability of the laser apparatus itself, hence obtaining an ink jet recording head without variations in the configuration of grooves and the depths thereof.

Also, in accordance with the present invention, it is possible to adopt a structure which enables drilling to be effectuated only on a thin orifice plate. As a result, discharge ports can be obtained in higher precision without variation of the hole area thereof.

As described above, in accordance with the present invention, it is easier to manufacture a large ink jet recording head having many ink discharge ports (2,000 or more, for example) at lower costs, hence materializing an ink jet recording head which is particularly suitable for use of the full line type.

What is claimed is:

1. An ink jet recording head, comprising:

a plurality of discharge ports for discharging ink;

a plurality of ink flow paths in communication with said plurality of discharge ports;

a plurality of substrates that includes a discharge energy generating element for providing discharge energy for discharging ink;

a supporting member for supporting the plurality of arranged substrates; and a ceiling plate member for forming plurality of ink flow paths by being pressure bonded to the said plurality of arranged substrates using a pressure member, wherein said plurality of substrates are each provided with a member that forms a side wall of an ink flow path, and said ceiling plate member forms an ink flow path side wall at a region corresponding to a gap between the plurality of arranged substrates.

2. An ink jet recording head according to claim 1, wherein the member that forms the side wall is formed by lamination by means of masking using a dry film on the plurality of substrates.

3. An ink jet recording head according to claim 1, wherein said ceiling plate member is formed of a resin material.

4. An ink jet recording head according to claim 1, wherein the discharge energy generating element is an electrothermal converting member that generates thermal energy for use in discharging ink.

5. An ink jet recording head according to claim 4, wherein the electrothermal converting member discharges ink from said plurality of discharge ports through film boiling, which is created by the thermal energy generated by the electrothermal converting member.

6. An ink jet recording head according to claim 1, wherein said ink jet recording head is a full-line type recording head with a length corresponding to a recording width of a recording medium.

7. An ink jet recording head according to claim 1, wherein said ceiling plate member is provided with an orifice plate that includes said plurality of discharge ports.

8. A method for manufacturing an ink jet recording head provided with a plurality of discharge ports for discharging ink; a plurality of ink flow paths in communication with the plurality of discharge ports; a plurality of substrates that includes a discharge energy generating element for providing discharge energy for discharging ink; a supporting member for supporting the plurality of arranged substrates; and a ceiling plate member for forming the plurality of ink flow paths by being pressure bonded to the plurality of arranged substrates, said method comprising the following steps of:

providing a member that forms a side wall of an ink flow path on each of the plurality of arranged substrates;

providing an ink flow path side wall on the ceiling plate member at a region corresponding to a gap between the plurality of arranged substrates; and forming the plurality of ink flow paths by bonding the ceiling plate member, which includes the ink flow path side wall, with the plurality of arranged substrates, each of which includes a member that forms a side wall of an ink flow path, wherein the plurality of arranged substrates and the ceiling plate member are pressure bonded using a pressure member.

9. A method for manufacturing an ink jet recording head according to claim 8, wherein the ceiling plate member is provided with an abutting surface for abutting an end portion of the plurality of arranged substrates to be in contact therewith, and the abutting surface and an orifice plate that includes the plurality of discharge ports are formed by a simultaneous cutting process.

10. A method for manufacturing an ink jet recording head according to claim 8, wherein the ceiling plate member is formed of a resin material.

11. A method for manufacturing an ink jet recording head according to claim 8, wherein the member that forms the side wall of the ink flow path are laminated by means of masking using a dry film on the plurality of substrates.

* * * * *

UNITED STATES PATENT AND TRADEMARK OFFICE

CERTIFICATE OF CORRECTION

PATENT NO. : 6,331,051 B1
APPLICATION NO. : 09/188107
DATED : December 18, 2001
INVENTOR(S) : Hiroki Tajima et al.

It is certified that error appears in the above-identified patent and that said Letters Patent is hereby corrected as shown below:

COLUMN 1

Line 64, “exerts” should read --exert--.

COLUMN 2

Line 31, “presents” should read --prevents--.

COLUMN 8

Line 22, “member” should read --members--.

COLUMN 13

Line 14, “Application” should read --application--;
Line 64, “plurality” should read --said plurality--; and
Line 65, “said” should be deleted.

COLUMN 14

Line 64, “path are” should read --path is--.

Signed and Sealed this

Fifth Day of February, 2008

JON W. DUDAS
*Director of the United States Patent and Trademark Office*